US006085058A

United States Patent [19]

Goto et al.

[11] Patent Number: 6,085,058

[45] Date of Patent: Jul. 4, 2000

[54] IMAGE FORMING APPARATUS HAVING TRANSFER ROTARY MEMBER WITH SURFACE FRICTION GREATER THAN THAT OF IMAGE BEARING MEMBER

[75] Inventors: Masahiro Goto; Hiroto Hasegawa, both of Mishima; Toshio Miyamoto, Numazu; Yuko Ohkama, Yokohama, all of Japan

[73] Assignee: Canon Kabushiki Kaisha, Tokyo, Japan

[21] Appl. No.: 08/963,983

[22] Filed: Nov. 4, 1997

[30] Foreign Application Priority Data

Nov. 6, 1996 [JP] Japan ..... 8-310022

[51] Int. Cl.[7] ..... G03G 15/16; G03G 15/20

[52] U.S. Cl. ..... 399/313; 399/314; 399/328; 399/333

[58] Field of Search ..... 399/121, 122, 399/154, 159, 210, 297, 303, 310, 313–319, 320, 328–331, 335, 339, 333; 492/49, 53, 56, 59

[56] References Cited

U.S. PATENT DOCUMENTS

| | | | |
|---|---|---|---|
| 4,652,110 | 3/1987 | Sato et al. | 399/406 |
| 4,883,715 | 11/1989 | Kuge et al. | 219/216 |
| 5,153,654 | 10/1992 | Yuminamochi et al. | 399/318 |
| 5,159,393 | 10/1992 | Hiroshima et al. | 399/313 |
| 5,264,902 | 11/1993 | Suwa et al. | 399/333 |
| 5,285,245 | 2/1994 | Goto et al. | 399/322 |
| 5,289,247 | 2/1994 | Takano et al. | 399/68 |
| 5,406,360 | 4/1995 | Asai | 399/313 |
| 5,438,398 | 8/1995 | Tanigawa et al. | 399/302 |
| 5,610,690 | 3/1997 | Yoshihara et al. | 399/167 |

FOREIGN PATENT DOCUMENTS 0 666 519 8/1995 European Pat. Off. .

OTHER PUBLICATIONS

Patent Abstracts of Japan, vol. 015, No. 391 (p–1259), Oct. 3, 1991 & JP 03–155584 A (Canon Inc.), Jul. 3, 1991.

Patent Abstracts of Japan, vol. 096, No. 004, Apr. 30, 1996 & JP 07–319302 A (Fuji Xerox Co. Ltd.), Dec. 8, 1995.

Patent Abstracts of Japan, vol. 096, No. 010, Oct. 31, 1996 & JP 08–146789 A (Fuji Xerox Co. Ltd.), Jun. 7, 1996.

*Primary Examiner*—Arthur T. Grimley
*Assistant Examiner*—William A. Noëe
*Attorney, Agent, or Firm*—Fitzpatrick, Cella, Harper & Scinto

[57] ABSTRACT

The present invention provides an image forming apparatus having an image bearing member for bearing a toner image, and a transfer rotary member for forming a nip between the transfer rotary member and the image bearing member, the transfer rotary member being provided at its surface with a solid layer and serving to transfer the toner image from the image bearing member onto a transfer material at the nip, and wherein a moving speed of a surface of the transfer rotary member at the nip is greater than a moving speed of a surface of the image bearing member at the nip, and a surface friction force of the transfer rotary member is greater than a surface friction force of the image bearing member by 3 to 20 times.

10 Claims, 3 Drawing Sheets

IMAGE FORMING APPARATUS HAVING TRANSFER ROTARY MEMBER WITH SURFACE FRICTION GREATER THAN THAT OF IMAGE BEARING MEMBER

BACKGROUND OF THE INVENTION

FIELD OF THE INVENTION

The present invention relates to an image forming apparatus having a transfer rotary member for transferring an image from an image bearing member to a transfer material.

More preferably, the present invention relates to an image forming apparatus in which a toner image (transferable image) corresponding to desired image information is formed on an image bearing member (electrostatic latent image bearing member) such as a drum-shaped electrophotographic photosensitive member or a drum-shaped electrostatic recording dielectric member by utilizing an appropriate image forming process such as electrophotographic process or electrostatic recording process, and the toner image is transferred from the image bearing member onto a recording material (transfer material, such as a paper sheet by a transfer means, and the recording material to which the toner image was transferred is sent to a fixing means, where the toner image is fixed to the recording material as a permanent fixed image to form an imaged material (copy, print) which is in turn outputted from the image forming apparatus, and the image bearing member is repeatedly used for forming successive images.

RELATED BACKGROUND ART

In image forming apparatuses of the transfer type, as a transfer means for electrostatically transferring a toner image formed on an image bearing member onto a recording material, a corona transfer device, a roller transfer device or a belt transfer device has widely been used.

(a) Corona Transfer Device

In this corona transfer device, a corona discharger is disposed in a confronting relation to an image bearing member without contact therebetween. By introducing a recording material between the image bearing member and the corona discharger and by applying corona discharge having polarity opposite to that of toner to a rear surface of the recording material from the corona discharger, a toner image is electrostatically transferred from the image bearing member to a front surface of the recording material.

(b) Roller Transfer Device

In this roller transfer device, a conductive elastic roller (transfer roller) is urged against an image bearing member to form a transfer nip (contact nip) therebetween. By introducing a recording material into the transfer nip and by applying voltage having polarity opposite to that of toner to the transfer roller while the recording material being conveyed through the transfer nip, a toner image is electrostatically transferred from the image bearing member to a front surface of the recording material.

(c) Belt Transfer Device

In this belt transfer device, a recording material electrostatically absorbed on a belt-shaped rotary member is conveyed to a toner image transfer portion of an image bearing member, where a toner image is electrostatically transferred from the image bearing member to a front surface of the recording material by an electrostatic force from the belt-shaped rotary member.

Among these transfer devices, the roller transfer device contributes to reduction of cost of the image forming apparatus and has widely been used recently, because less ozone is generated and the transfer roller also acts as a recording material conveying roller.

It is well-known that, in the roller transfer device acting as a transfer means for transferring the toner image from the image bearing member to the recording material, when the toner image formed on the image bearing member onto the recording material, since pressure acts on the toner image, a phenomenon (called as "hollow characters") that only a central portion of a character image is not transferred is apt to occur.

In order to avoid such a "hollow character" phenomenon, there has been proposed a method in which an urging force of the transfer roller is weakened or a method (as disclosed in Japanese Patent Application Laid-Open No. 3-155584) in which the transfer roller is rotated faster than the image bearing member (photosensitive drum) to enhance a toner scraping force. In many cases, "foam sponge" having low hardness is used as an elastic body from which the transfer roller is formed, and the foam sponge transfer roller is contacted with the photosensitive drum with small pressure and is rotated faster than the photosensitive drum.

However, the above-mentioned arrangement has the following drawback. That is to say, when there is a difference in peripheral speed between the transfer roller and the photosensitive drum, since the recording material is conveyed while always slipping with respect to both the transfer roller and the photosensitive drum, a conveying speed of the recording material becomes unstable.

More specifically, since the recording material is conveyed through the transfer nip between the photosensitive drum and the transfer roller at a speed slower than a peripheral speed of the transfer roller and faster than a peripheral speed of the photosensitive drum, the photosensitive drum always applies a braking force to the recording material in a direction opposite to the conveying direction.

In this case, if toner exists between the photosensitive drum and the recording material, since the braking force is varied with an amount of toner, there arises a phenomenon that, when a pattern having high print ratio is printed, the braking force of the photosensitive drum is decreased which increases a recording material conveying force of the transfer roller accordingly, thereby increasing the conveying speed of the recording material, and, when a pattern having low print ratio is printed, the braking force of the photosensitive drum is increased which decreases the conveying speed of the recording material.

In consideration of such a phenomenon, when the conveying speed of the recording material is faster than the peripheral speed of the photosensitive drum at the transfer nip so much that it does not obtain a good images with no hollow characters, the good image can be obtained with normal character images, but, regarding patterns having high print ratio such as half tone, if the image is printed on the whole surface of the recording material, a part of the image will frequently project from a rear end of the recording material.

In order to avoid a problem caused by the change in print accuracy in such image patterns, the peripheral speed of the transfer roller must be set within a range that both the "hollow character" and the "image projection" can be prevented for both high print ratio pattern and low print ratio pattern.

To this end, the outer diameter of the transfer roller must be controlled with high accuracy, with the result that the manufacturing yield for transfer rollers is poor.

Further, since the transfer roller is gradually worn, the service life of the transfer roller is shortened.

SUMMARY OF THE INVENTION

An object of the present invention is to provide an image forming apparatus which can prevent "hollow character" or transfer void of an image even when a transfer rotary member is used.

Another object of the present invention is to provide an image forming apparatus which can maintain good print accuracy regardless of image patterns.

A further object of the present invention is to provide an image forming apparatus which permits mass production of transfer rollers and improves a service life of the transfer roller.

The other objects and features of the present invention will be apparent from the following detailed explanation referring to the accompanying drawings.

DETAILED DESCRIPTION OF THE PREFERRED EMBODIMENTS

The present invention will now be explained in connection with embodiments thereof with reference to the accompanying drawings.

Figure 1A:
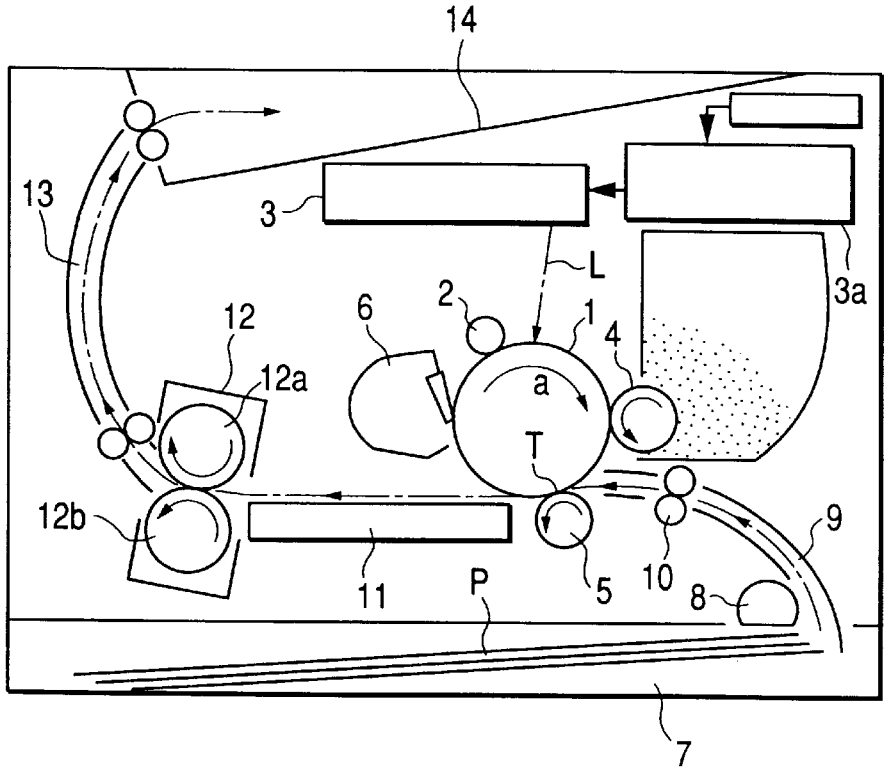
FIG. 1A is a schematic sectional view of an image forming apparatus according to a first embodiment of the present invention.
Figure 1B:
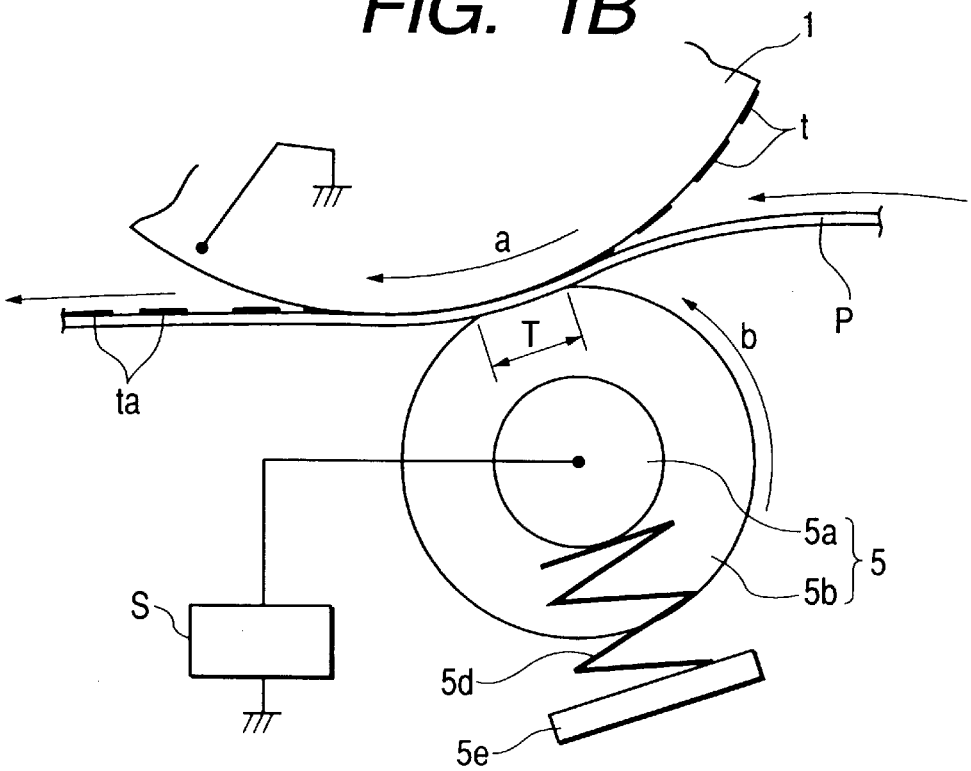
FIG. 1B is an enlarged schematic view showing a transfer roller portion.
Figure 2:
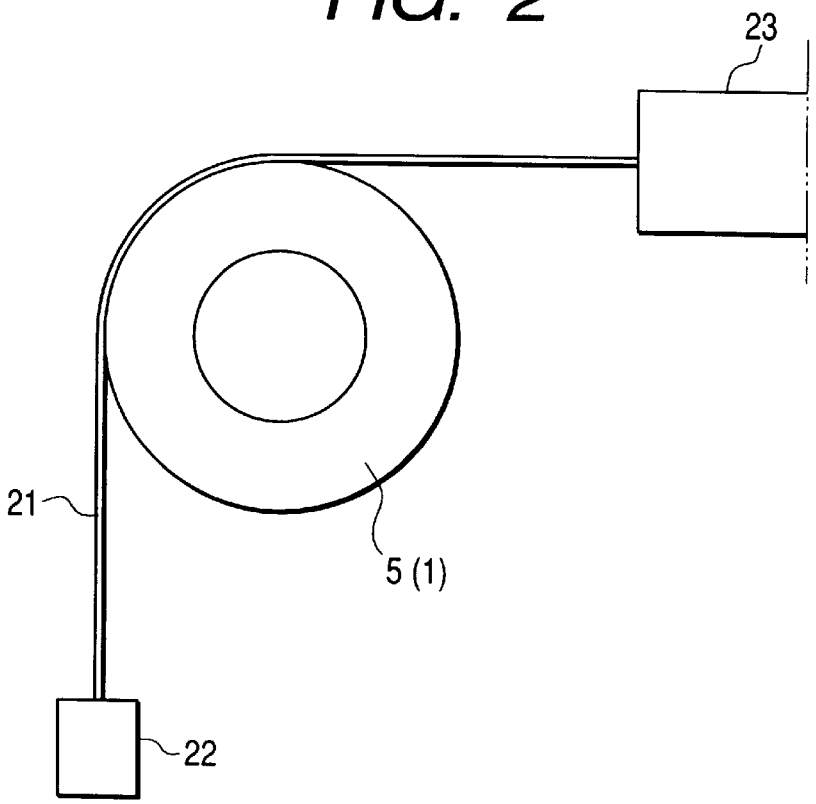
FIG. 2 is an explanatory view showing a method for measuring friction forces of a transfer roller and a photosensitive drum.

First Embodiment (FIGS. 1A, 1B and 2)

(1) Image Forming Apparatus

FIG. 1A is a schematic sectional view of an image forming apparatus. The image forming apparatus according to this embodiment is embodied as a laser beam printer utilizing transfer electrophotographic process.

A rotatable drum-shaped electrophotographic photosensitive member 1 serving as an image bearing member (referred to as "photosensitive drum" hereinafter) is rotated in a clockwise direction shown by the arrow a at a predetermined process speed (peripheral speed). The photosensitive drum 1 is constituted by a cylinder (drum base or drum substrate) made of aluminum or nickel which is grounded, and a photosensitive layer made of OPC (organic photoconductor), amorphous Se or amorphous Si which is coated on the cylinder. The photosensitive drum 1 used in this embodiment is constituted by an aluminum cylinder and an OPC layer having a CT layer (change transfer layer) mainly including polycarbonate binder and has an outer diameter of 30 mm.

A charge roller 2 serves to uniformly charge an outer surface of the rotating photosensitive drum 1 with predetermined polarity and potential. In this embodiment, a charge roller of contact charging type serves as a charge means.

In the illustrated embodiment, an image information exposure means 3 is constituted by a laser beam scanner including a semi-conductor laser, a polygon mirror and an F-θ lens and serves to emit laser light L modulated (ON/OFF-controlled) in response to time-lapse electrical digital pixel signal corresponding to desired image information inputted to a control portion 3*a* from a host device (not shown) such as an original reading device, a computer or a word processor, thereby scanning and exposing the uniformly charged surface of the photosensitive drum 1 to form an electrostatic latent image corresponding to the desired image information on the outer surface of the rotating photosensitive drum 1.

An electrostatic latent image developing device 4 serves to develop the electrostatic latent image formed on the rotating photosensitive drum 1 as a toner image. A developing method may be a jumping developing method, a two-component developing method or a FEED developing method, and it is preferable that image exposure and inverse development are combined.

The toner image formed on the rotating photosensitive drum 1 is successively transferred onto a recording material (transfer material) P (which is supplied from a sheet supply portion to a transfer nip T) at the transfer nip T by means of a transfer roller which serves as a transfer means. The transfer roller will be fully explained in an item (2) which will be described later.

The sheet supply portion includes a sheet supply cassette 7 within which a plurality of recording materials P are stacked. The recording materials P are separated and supplied one by one by a sheet supply roller 8, and the separated recording material is conveyed to a pair of register rollers 10 through a sheet path 9. The pair of register rollers 10 serves to supply the recording material P to the transfer nip T between the rotating photosensitive drum 1 and the rotating transfer roller 5 at a predetermined control timing. The transfer roller 5 serves to electrostatically transfer the toner image formed on the photosensitive drum 1 onto the recording material P at the transfer nip T.

The recording material P to which the toner image was transferred in passing through the transfer nip T is separated from the rotating photosensitive drum 1 and is guided by member 11 into a fixing device 12, where the toner image is fixed to the recording material.

In the illustrated embodiment, the fixing device 12 is of heat-roller type which includes a heat roller or fixing roller (heating rotary member) 12*a* and an elastic pressure roller (pressurizing rotary member) 12*b*. While the recording material P is being passed through a fixing nip between the fixing roller 12*a* and the elastic pressure roller 12*b*, a non-fixed toner image transferred to the recording material P is fixed onto the recording material P by heat and pressure, thereby forming a permanent image.

The recording material P leaves the fixing device 12 and is discharged onto a sheet discharge tray 14 through a sheet path 13.

After the recording material is separated from the photosensitive drum, residual toner remaining on the surface of the photosensitive drum 1 is removed by a cleaning device (cleaner) 6, thereby preparing for the next image formation.

(2) Transfer Roller 5

FIG. 1B is an enlarged schematic view of the transfer roller 5.

The transfer roller 5 is constituted by a core cylinder 5*a* made of iron or SUS, and an elastic layer 5*b* made of solid elastomer such as EPDM (ethylene-propylene rubber), silicone NBR (nitrile-butadiene rubber) or urethane which is coated on the core cylinder. The transfer roller has hardness of 40 to 80 degrees (Asker-C hardness when a load of 1 Kg is applied) and a resistance value of $10^6$ to $10^{10}$ Ω.

If the resistance value is smaller than $10^6$ Ω, a difference between transfer currents flowing through a white portion and a black portion of the image becomes great (i.e., a transfer charge amount of the white portion becomes great in comparison with that of the black portion (toner image portion)), with the result that the toner is attracted toward the white portion by an electric field, thereby scattering the toner. On the other hand, if the resistance value is greater than $10^{10}$ Ω, transfer voltage required for passing sufficient transfer current through the paper sheet (recording material) becomes too great, with the result that it is difficult to maintain a distance (along the surface) on the high voltage substrate sufficient to prevent leakage at contact portions.

In the measurement of the resistance value, a conductive aluminum drum (having the same configuration as the photosensitive drum) is urged against the transfer roller, and the resistance value is determined on the basis of an amount of current flowing through the aluminum drum when voltage of 1 KV is applied to the transfer roller.

The transfer roller 5 is urged against the photosensitive drum 1 with predetermined pressure by means of a pressurizing spring 5*d* disposed between the core cylinder 5*a* and a fixed spring seat 5*e*, and the transfer nip T having a predetermined width is formed between the transfer roller and the photosensitive drum 1 by elastic deformation of the elastic layer 5*b*.

The transfer roller 5 receives a driving force from the photosensitive drum 1 through a drive gear (not shown) so that the transfer roller is rotated in an anti-clockwise direction shown by the arrow b at a predetermined peripheral speed ratio with respect to the photosensitive drum 1.

The peripheral speed ratio of the transfer roller 5 with respect to the photosensitive drum 1 is represented as follows:

$$Rt/(Rd \times Nt/Nd)$$

where, Rd is an outer diameter of the photosensitive drum 1, Nd is the number of teeth of a driving force transmitting gear of the photosensitive drum, Rt is an outer diameter of the transfer roller 5, and Nt is the number of teeth of a transfer roller driving gear.

Predetermined transfer bias is applied to the core cylinder 5*a* of the transfer roller 5 from a transfer bias power source S at a predetermined timing.

As mentioned above, the recording material P is sent to the transfer nip T at the predetermined control timing and is conveyed through the transfer nip T. While the recording material is being conveyed through the transfer nip T, the predetermined transfer bias having polarity opposite to that of the toner is applied to the core cylinder 5*a* from the power source S, with the result that the toner images t formed on the photosensitive drum 1 are successively transferred electrostatically onto the recording material P at the transfer nip T. The toner images transferred to the recording material P are designated by "ta".

Surface friction forces of the transfer roller 5 and the photosensitive drum 1 are determined by a method shown in FIG. 2. That is to say, a normal paper sheet 21 having a width of 50 mm (having a weight of 80 to 105 g/m$^2$) is wound around the transfer roller 5 (or photosensitive drum 1 ) and a weight 22 of 75 grams is suspended from the paper sheet. In this condition, by pulling a spring scale 23 (attached to the other end of the paper sheet) at a constant speed, a friction force of the transfer roller (or the photosensitive drum) is measured.

The urging force of the transfer roller 5 against the photosensitive drum 1 is calculated in the following manner. That is to say. toner or ink is uniformly coated on the photosensitive drum which is stationary, and the transfer roller 5 is contacted with the photosensitive drum while applying loads on both ends of the transfer roller. The width of the transfer nip between the transfer roller 5 and the photosensitive drum 1 is determined on the basis of a width of toner or ink adhered to the transfer roller 5 (nip width in the vicinity of a central portion in a longitudinal direction). A contact area is determined by multiplying a length of the elastic layer 5*b* of the transfer roller by the determined nip width, and the urging force is calculated on the basis of the contact area and the total load.

In accordance with such a measuring method, the solid elastic layer 5*b* is formed at the correct thickness on the transfer roller 5 and the difference in peripheral speed between the transfer roller 5 and the photosensitive drum 1 is determined. Further, the surface friction force of the transfer roller 5 is selected to be 3 to 20 times greater than the surface friction force of the photosensitive drum 1. In this way, stable print accuracy can be maintained regardless of image patterns and character images without hollow characters can be obtained.

In particular, in this case, when the urging force of the transfer roller 5 is selected to 200 to 800 g/cm$^2$ and the peripheral speed of the transfer roller 5 is selected to be faster than that of the photosensitive drum 1 by 1 to 5%, the above effect becomes more remarkable.

If the difference in the peripheral speed is smaller than 1%, good hollow character preventing effect cannot be achieved, and the rubbing force of the transfer roller against the photosensitive drum is weakened not to obtain the sufficient cleaning ability. On the other hand, if the difference in the peripheral speed is greater than 5%, the difference in conveying speed between the photosensitive drum and the recording material becomes too great, thereby making the print accuracy (feeding speed) unstable (causing skew-feed).

(3) Test Example (a) Transfer Roller 5 Used:

The transfer roller 5 used is constituted by an iron core cylinder 5*a* having a diameter of 6 mm and an elastic layer 5*b* made of EFDM and vulcanized and molded on the core cylinder. The desired diameter is obtained by polishing the elastic layer.

In this case, the hardness of roller is selected to 50 be degrees and the resistance value is selected to be $10^8$ Ω by controlling the mixture of EPDM.

The friction force of the surfaces of EPDM is reduced by dispersing fluororesin powder (trade mark "Ruvlon" manufactured by DAIKIN Co., Ltd. in Japan) into EPDM or is increased by dispersing silicone rubber into EPDM. A normal paper sheet having a weight of 75 g/M$^2$ is used as the recording material.

(b) Photosensitive Drum 1 Used:

The photosensitive drum 1 used is constituted by forming an OPC layer having a CT layer mainly including polycarbonate binder on an aluminum cylinder, as mentioned above. An outer diameter of the photosensitive drum is selected to 30 mm.

The transfer roller 5 receives a driving force from the photosensitive drum 1 via gears. The number of teeth of the gear of the transfer roller is selected to be 24 and the number of teeth of the gear of the photosensitive drum 1 is selected to be 43.

As a comparison example, a transfer roller (J) having an elastic layer made of foam EPDM is also used.

The following Table 1 shows results that surface friction forces of a plurality of transfer rollers r (A–J) and of the photosensitive drum 1 measured by using the method shown in FIG. 2.

TABLE 1

| Transfer roller 5 | Elastic layer 5b | Friction force (grams) | Ratio to photosensitive drum |
|---|---|---|---|
| A | only EPDM | 630 | 14.7 times |
| B | EPDM + fluororesin of 5 parts | 502 | 11.7 times |
| C | EPDM + fluororesin of 10 parts | 375 | 8.7 times |
| D | EPDM + fluororesin of 20 parts | 250 | 5.8 times |
| E | EPDM + fluororesin of 30 parts | 130 | 3.0 times |
| F | EPDM + fluororesin of 40 parts | 85 | 2.0 times |
| G | EPDM + silicone rubber of 10 parts | 740 | 17.2 times |
| H | EPDM + silicone rubber of 20 parts | 850 | 19.8 times |
| I | EPDM + silicone rubber of 30 parts | 1230 | 28.6 times |
| J | EPDM foam sponge | 950 | 22.1 times |

(Note: Friction force of photosensitive drum = 43 grams)

The following Table 2 shows conveying speed ratios of the recording material P to the peripheral speed of the photosensitive drum 1 obtained by changing the print ratio of the image on the photosensitive drum 1 from 2% or less to 35%.

Incidentally, the conveying speed of the recording material P is measured on the basis, of a ratio (image magnification) between a length of the image formed on the photosensitive drum 1 and a length of the image recorded on the recording material.

TABLE 2

| Transfer roller | A | B | C | D | E |
|---|---|---|---|---|---|
| Outer diameter (peripheral speed ratio) | 17.05 (1.02) | 17.1 (1.02) | 17.2 (1.03) | 17.3 (1.03) | 17.4 (1.04) |
| Image Magnification (%) | +1.3 | +1.4 | +1.5 | +1.8 | +2.0 |
| Cleaning ability | ○ | ○ | ○ | ○ | ○ |
| **Transfer roller** | **F** | **G** | **H** | **I** | **J** |
| Outer diameter (peripheral speed ratio) | 17.6 (1.05) | 17.0 (1.02) | 16.95 (1.01) | 16.9 (1.01) | 17.8 (1.06) |
| Image Magnification (%) | +2.8 | +1.4 | +1.1 | +1.0 | +3.1 |
| Cleaning ability | ○ | ○ | Δ | x | ○ |

○: good, Δ: average, x: bad

First of all, outer diameters of the transfer rollers A–J are set so that the image magnification ((=) corresponding to peripheral speed ratio) of the recording material P to the photosensitive drum 1 becomes +1% in the Table 2 when a line image having print ratio of 2% or less is printed. By achieving this value (+1%), it was found that character images without hollow characters can be obtained.

The peripheral speed ratios shown in parentheses are values calculated on the basis of the outer diameters of the transfer rollers and ratios between the gears of the transfer rollers and the gear of the photosensitive drum.

Each image magnification shown in the Table 2 is magnification of the image formed on the recording material when an image having print ratio of 35% is printed on the recording material by using the transfer roller having the outer diameter selected as mentioned above.

The cleaning ability is determined by judging whether or not the toner adhered to the transfer roller is adequately transferred to the photosensitive drum, after the toner on the photosensitive drum was directly transferred to the transfer roller and thereafter the transfer roller was rotated by two revolutions while applying voltage (−1 KV to 2 KV) having the same polarity as that of the toner to the transfer roller. As a concrete judging method, after the transfer roller was rotated by two revolutions as mentioned above, a white recording material is passed between the transfer roller and the photosensitive drum, and then it is visually judged whether or not the rear surface of the recording material is smudged by the toner.

As can be seen from the Table 2, when the image print ratio is 2% or less, the image magnification on the image on the recording material is +1%, but, when the image print ratio is changed to 35%, the image magnification is changed, and it can be seen that the amount of change of the image magnification depends upon the surface friction force when the solid elastic layer (transfer rollers A–I) is used. Further, when the elastic layer of the transfer roller is made of sponge (transfer roller J), the magnification difference due to the image print ratio becomes very large in spite of the fact that the surface friction force is great.

The reason for a the magnification difference is that, when the elastic layer is solid (transfer rollers A–I), after the elastic layer is deformed in the transfer nip T, a restoring force of the elastic layer is great because the volume is unchanged, with the result that the recording material P does not easily slip; on the other hand, when the sponge is used as the elastic layer (transfer roller J), although the friction force is great, since the volume is decreased during the deformation in the transfer nip T, the restoring force of the elastic layer is small, with the result that the recording material P is apt to slip more easily.

It is known that so long as the image magnification difference due to the change in image print ratio is 1% or less (i.e., image magnification at the print ratio of 35% in the Table 2 is 2% or less) there is no problem at the practical use, and, thus, it can be seen from the Table 2, the transfer rollers other than the transfer rollers F and J have sufficient conveying forces.

On the other hand, the cleaning ability for the transfer roller is determined by a relation between friction forces of the transfer roller and the photosensitive drum, and the smaller the value of the friction force the more preferable. From the result shown in Table 1, the value of the friction force in the case of the solid elastic layer (transfer rollers A–I) becomes smaller in comparison with the case where the sponge is used (transfer roller J), but, so long as the ratio of the friction force is 20 or less, there is no problem at the practical use.

From the above explanation, by using the solid elastomer as the elastic layer of the transfer roller and by selecting the friction force of the transfer roller to become greater than that of the photosensitive drum by 3 to 20 times, the recording material can be conveyed stably and the good cleaning ability for the transfer roller can be maintained.

According to the Inventors' investigation, it was found that the cleaning ability for the transfer roller also depends upon the difference in peripheral speed between the transfer roller and the photosensitive drum. Further, it was found that, if the peripheral speed difference is 1.0% or less, the adequate cleaning ability cannot be obtained, and, in a cleaning system in which voltage having the same polarity as that of the toner is applied, it is preferable that there is provided a difference in peripheral speed between the transfer roller and the photosensitive drum in order to obtain an adequate force for transferring the toner adhered to the transfer roller onto the photosensitive drum, as well as for the prevention of the hollow characters. Thus, by applying the voltage having the same polarity as that of the toner at a timing other than the transfer timing, the surface of the transfer roller can always be maintained in a clean condition.

Further, the urging force of the transfer roller against the photosensitive drum is one of important parameters for achieving the technical effect of the present invention. It was found that, if the urging force is too small, the adequate conveying force for the recording material cannot be obtained and, in particular, the print magnification is changed in dependence upon the weight of the recording material. For example, the sufficient urging force required in order to convey the recording material having a weight of 60 to 200 g/m$^2$ at the constant print magnification, and, in this case, it is preferable that the elastic layer of the transfer roller is solid. On the other hand, if the urging force is too great, even when there is provided the difference in peripheral speed between the transfer roller and the photosensitive drum, it is difficult to prevent the hollow characters sufficiently. In the case of the transfer roller having the solid elastic layer, it was found that the above effect can be obtained by using an urging force of 200 to 800 g/cm$^2$ (which is relatively high for the urging force of the transfer roller).

Figure 3:
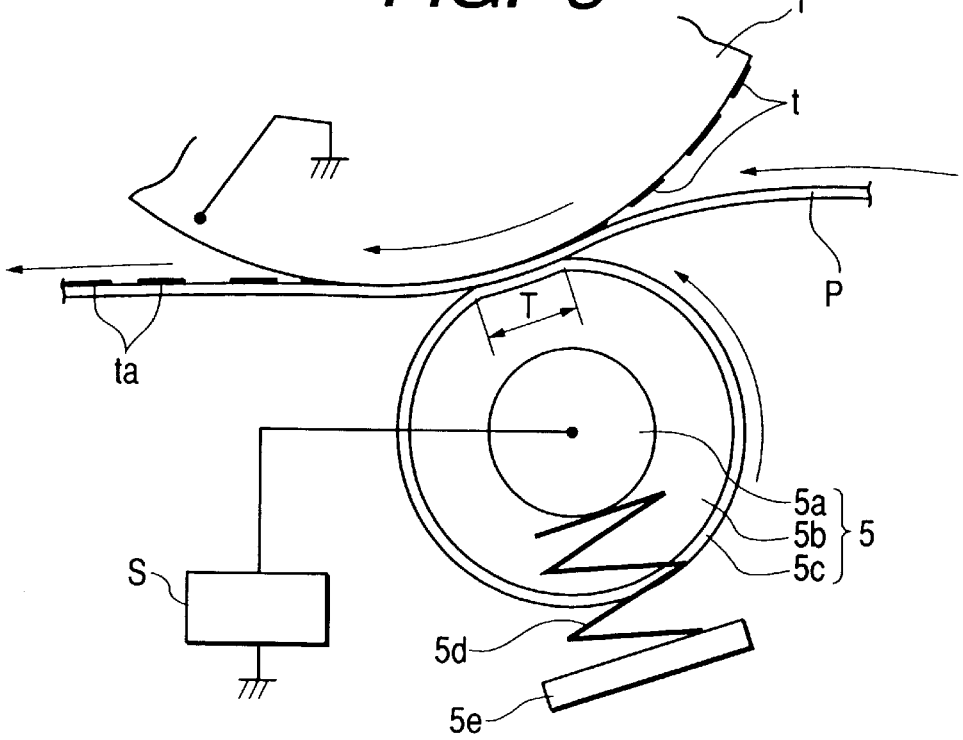
FIG. 3 is an enlarged schematic view showing a transfer roller portion of an image forming apparatus according to a second embodiment of the present invention.

Second Embodiment (FIG. 3)

A second embodiment of the present invention differs from the above-mentioned first embodiment in the point that an elastic layer or resin layer 5*c* for adjusting a surface friction force is provided on a transfer roller 5 as shown in FIG. 3. That is to say, in the second embodiment, the transfer roller 5 is constituted by a core cylinder 5*a*, a solid elastic layer 5*b* formed on the core cylinder, and an elastic layer or resin layer 5*c* coated on the elastic layer and adapted to adjust a surface friction force.

With this arrangement, the degree of freedom for selecting materials for the transfer roller is increased, in comparison with the case where the surface friction force of the transfer roller is controlled only by the elastic layer 5*b*.

For example, when the friction force of the solid elastic layer is reduced to obtain adequate cleaning ability, if a low friction material such as fluororesin is dispersed in the elastic layer, physical values of the elastic layer such as tear strength, tensile strength and the like may be reduced to reduce the strength of the transfer roller, thereby generating cracks in the elastic layer for long term use. In order to prevent such a drawback, in the second embodiment, the elastic layer 5*b* can be made of rubber material such as EPDM, NBR, CR (chloroprene rubber), silicone, isoprene, urethane or the like, and the surface layer 5*c* can be made of rubber material such as EPDM, NBR, silicone, urethane or the like or material obtained by dispersing low friction substance such as fluororesin in the rubber material. Further, the same effect can be obtained by providing a resin layer (made of nylon, urethane, acryl or the like) on the surface layer 5*c*.

According to a preferred aspect of the second embodiment, a thickness of the surface layer (rubber layer) 5*c* covering the elastic layer 5*b* is preferably 0.3 to 1 mm. If the thickness is too small, it is difficult to form the surface layer 5*c*, and, if the thickness is too great, the durability will be worsened as mentioned above.

As in the transfer roller 5 of the first embodiment, a transfer roller having hardness of 40 to 80 degrees (Asker-C hardness when a load of 1 Kg is applied) and a resistance value of $10^6$ to $10^{10}$ Ω is used.

When the surface layer 5*c* includes the resin layer, the thinner a thickness of the resin layer the more preferable in order to obtain an adequate recording material holding force provided by the elasticity of the elastic layer 5*c* and the restoring force of the deformed nip (between the transfer roller and the photosensitive drum). It is important that the thickness is smaller than 50 μm and preferably smaller than 30 μm in order to achieve the effect of the present invention. The lower limit of the thickness determines the service life of the transfer roller, and, thus, the thickness is preferably greater than 10 μm. In the above arrangement, the features required for the transfer roller are the same as those in the first embodiment.

Now, a concrete example will be described.

The transfer roller 5 is constituted by an iron core cylinder 5*a* having a diameter of 6 mm, an NBR elastic layer 5*b* having a thickness of 5 mm and provided on the core cylinder, and a surface layer (elastic layer) 5*c* having a thickness of 0.5 mm coated on the elastic layer 5*b* and formed by dispersing fluororesin of 20 parts in EPDM. The outer diameter of the transfer roller is selected to 17.0 mm.

The hardness of the transfer roller 5 is selected to 55 degrees (Asker-C hardness when a load of 1 Kg is applied) and the resistance value is selected to $3\times10^8$ Ω.

As a result of the same evaluation as that in the first embodiment was performed by using this transfer roller, it was found that the friction force ratio of the transfer roller 5 to the photosensitive drum 1 becomes 9.0 and the image magnification on the recording material is maintained to +1% to +1.2% with respect to the photosensitive drum 1 regardless of the image print ratio.

Further, it was found that the durability is excellent so that, even after 300,000 normal sheets having A4 size were printed, abnormality is not appeared on the surface layer 5*c* of the transfer roller 5 and the same ability as the initial ability can be maintained.

Further, by using the same evaluation as that in the first embodiment with a transfer roller constituted by an iron core cylinder 5*a* having a diameter of 6 mm, an NBR elastic layer 5*b* having a thickness of 5 mm and provided on the core cylinder, and a urethane resin layer 5*c* (as surface layer) having a thickness of 30 μm coated on the elastic layer 5*b* and formed by dispersing fluororesin in the urethane resin and having the hardness of 50 degrees (Asker-C hardness when a load of 1 Kg is applied) and the resistance value of $2\times10^8$ Ω, it was found that the friction force ratio of the transfer roller 5 to the photosensitive drum 1 becomes 8.1 and the image magnification on the recording material is maintained to +1% to +1.2% with respect to the photosensitive drum 1 regardless of the image print ratio.

Further, it was found that the durability is excellent so that, even after 300,000 normal sheets having A4 size were printed, abnormality is not appeared on the surface layer 5*c* of the transfer roller 5 and the same ability as the initial ability can be maintained.

Third Embodiment

A further example of a transfer roller 5 is described below.

In this transfer roller 5, an elastic layer 5*b* is made of thermoplastic elastomer of polyethylene group, polyester group, polyurethane group, silicone group or fluororesin group, and a desired diameter of the transfer roller is obtained by pouring the elastomer into a mold.

By using the thermoplastic elastomer as the elastic layer 5*b*, in comparison with the transfer roller obtained by vulcanizing the rubber material, molding ability is excellent, a surface polishing process can be omitted, and a cheaper transfer roller can be obtained.

Also in this third embodiment, the features required for the transfer roller are the same as those in the first embodiment, and, thus, the surface friction force ratio of the transfer roller to the photosensitive drum, the urging force of the transfer roller and the peripheral speed relation between the transfer roller and the photosensitive drum may be the same as those in the first embodiment.

As a concrete example, by molding pellet obtained by dispersing fluororesin powder (as friction force adjusting substance) and carbon black/metal oxide (as resistance value adjusting substance) in thermoplastic elastomer of polyester group onto an iron core cylinder 5*a* having a diameter of 6 mm, a transfer roller having no parting line and having accurate dimension (due to stable heat shrinkage) can be obtained.

According to the Inventor's investigation, it was found that the accuracy of the outer diameter obtained by the molding can be maintained within a range of ±0.3 mm, and, thus, the accuracy of the outer diameter is not enhanced by a polishing process. Therefore, cheaper transfer rollers can be manufactured at mass production.

Further, it was ascertained that the durability is excellent so that, even after 300,000 sheets were printed, the same ability as the initial ability can be maintained.

Figure 4:
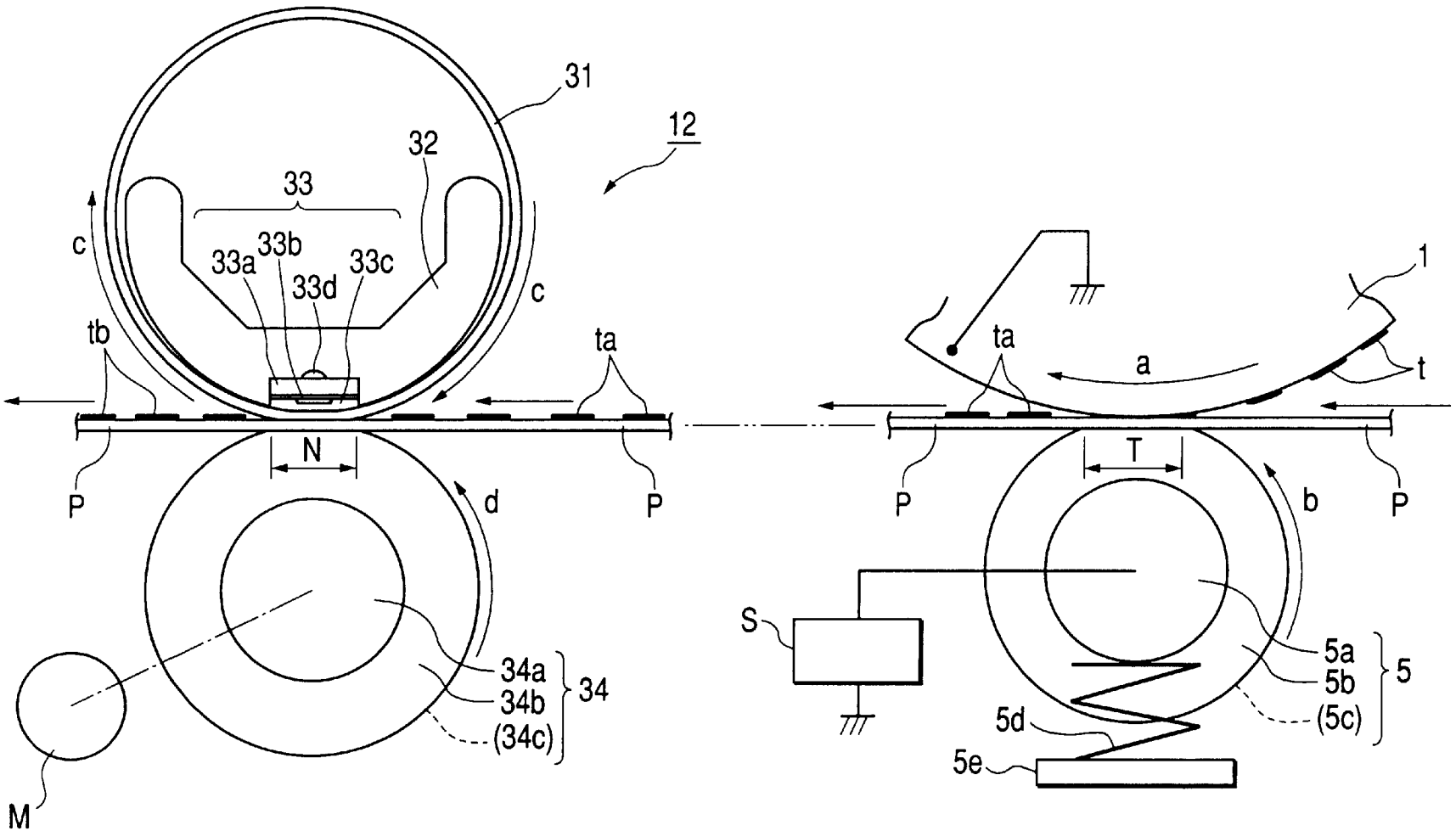
FIG. 4 is a schematic sectional view showing a main part of an image forming apparatus according to a fourth embodiment of the present invention.

Fourth Embodiment (FIG. 4)

In a fourth embodiment of the present invention, a heating device of film heating type and pressure rotary member driving type is used as an image heating/fixing device 12 of the image forming apparatus according to the first embodiment. FIG. 4 is a schematic view of such a heating device 12.

A cylindrical (endless) heat-resistive film (fixing film) 31 acting as a heating rotary member is formed as a single film layer made of PTFE (polytetrafluorethylene), PFA (perfluoralkoxy) or PPS (polyphenylene sulfide) having good heat resistance, mold releasing ability, strength and durability or a laminated film comprised of a film layer made of polyimide, polyamideimide, PEEK (polyether-ether-ketone) or PES (polyether sulfone) and a mold releasing coating layer made of PTFE, PFA OR FEP (ethylene-propylene fluoride), in order to reduce heat capacity and improve quick start ability.

The cylindrical heat-resistive film 31 is loosely mounted around a semi-cylindrical film guide member (stay) 32 having U-shaped cross-section.

A line heating body 33 having low heat capacity is disposed on a lower surface of the film guide member 32 at a central portion thereof along a longitudinal direction of the film guide member. For example, the heating body 33 is a ceramic heater (having low heat capacity entirely) including a heat resistive and insulative heater substrate 33*a* made of alumina or the like, silver/palladium heat generating body (resistive heat generating body) 33*b* printed on the heater substrate, a heat-resistive surface protecting layer 33*c* made of glass or the like, and a temperature detecting element 33*d* such as a thermistor.

In such a fixing device of film heating type, since the line heating body having low heat capacity such as the ceramic heater can be used as the heating body and a thin film having low heat capacity can be used as the film, energy can be saved and a waiting time can be shortened (to improve quick start ability).

An elastic pressure roller (pressurizing rotary member) 34 is constituted by a core cylinder 34*a* made of iron or aluminum, and an elastic layer 34*b* made of silicone rubber and provided on the core cylinder. The pressure roller 34 is urged against the heating body 33 on the lower surface of the film guide 32 with the interposition of the film 31 to form a fixing nip N. In the fixing nip N, the film 31 is pinched between the deformed elastic layer 34*b* of the pressure roller 34 and the heating body 33.

The pressure roller 34 is rotatingly driven in an anti-clockwise direction shown by the arrow d by means of a drive means M. When the pressure roller 34 is rotated, the film 31 is subjected to a rotating force based upon a friction force between the pressure roller 34 and the outer surface of the cylindrical film 31 at the fixing nip N, with the result that the film 31 is rotatingly driven along the film guide 32 in a clockwise direction shown by the arrow c while the inner surface of the cylindrical film 31 is being slid on the lower surface of the heating body 33 (pressurizing rotary member driving type).

While the film 31 is being rotated by the rotation of the pressure roller 34, when electric power is applied to the heat generating body 33*b* of the heating body 33, the heat generating body 33*b* generate heat to heat the fixing nip N to a predetermined temperature. In a condition that the fixing nip N is temperature-adjusted to the predetermined temperature by controlling the electric power applied to the heat generating body 33*b* by means of a temperature adjusting system including the temperature detecting element 33*d*, when the recording material P to which the non-fixed toner images ta were transferred at the transfer nip T is introduced into the fixing nip N (between the film 31 and the pressure roller 34 ), the recording material P is passed through together with the film in an overlapped condition (with the non-fixed toner images closely contacted with the film 31 ). Meanwhile, the heat from the heating body 33 is applied to the recording material P via the film 31, thereby thermally fixing the non-fixed toner images ta onto the recording material P. The recording material P leaving the fixing nip N is separated from the curved film 31. The thermally fixed toner images are designated by "tb". Incidentally, a distance between the transfer nip and the fixing nip along the recording material convey path is selected to be smaller than a maximum length of the recording material usable in the image forming apparatus and is preferably selected to be smaller than a minimum length of the recording material usable in the image forming apparatus.

In the heating/fixing device 12 of film heating type and pressurizing rotary member driving type having the above-mentioned arrangement, a conveying speed of the recording material at the fixing nip N is determined by a peripheral speed of the pressure roller 34.

Accordingly, if thermal expansion of the pressure roller 34 (as the drive roller) is great, since the peripheral speed of the pressure roller is apt to be changed due to change in outer diameter of the pressure roller, when the recording material P is pinched by both the transfer nip T (image forming portion) and the fixing nip N of the heating/fixing device 12 as is in the conventional cases, the recording material P is pulled by the heating/fixing device 12, with the result that the formed image is elongated or sheared, and, if parallelism between the heating/fixing device 12 and the photosensitive drum 1 is poor, the formed image is made oblique.

On the other hand, if the recording material conveying speed of the pressure roller 34 is too small in comparison with the recording material conveying speed of the transfer roller 5, a large loop is formed in the recording material P between the transfer nip T and the fixing nip N, with the result that, for example, the recording material is slidingly contacted with the lower surface of the cleaning device 6, thereby distorting the image.

When the recording material conveying speed of the transfer roller 5 is faster than the recording material conveying speed of the pressure roller 34, so long as the difference in the recording material conveying speed is within a range of 1%, there is no problem at the practical use, except for image forming apparatuses in which a distance between a transfer nip T and a fixing nip N is extremely short.

On the other hand, when the recording material conveying speed of the transfer roller 5 is slower than the recording material conveying speed of the pressure roller 34, a level for causing a problem regarding the image is varied with the recording material holding force of the transfer roller 5. According to the Inventors' investigation, it was found that the change in the recording material conveying speed of the pressure roller 34 depends upon the accuracy of the outer diameter of the pressure roller and is within a range of 0.6 to 1.2%, and the change in the recording material conveying speed of the pressure roller due to the thermal expansion of the pressure roller is within a range of 1.2 to 1.8% when the silicone rubber layer having a thickness of 5 mm or less is used.

Accordingly, when the change in the recording material conveying speed can be absorbed by 3% at the maximum, the pressure rollers can be manufactured at mass production and the image forming apparatus can be made compact.

As described in connection with the first embodiment, when the solid elastic layer **5*b* is used in the transfer roller 5, since the change in the recording material conveying speed due to the change in the image print ratio is 1% or less, the change in the conveying speed of 4% at the maximum (1% of change in the conveying speed due to the change in the image print ratio+above-mentioned 3% of change in the conveying speed) may be absorbed. So long as the change in speed of 3% generated when the recording material P is pulled by the pressure roller 34** can be absorbed, there is substantially no problem.

On the other hand, when the foam sponge is used as the elastic layer of the transfer roller, the recording material conveying speed is apt to be changed depending upon the image print ratio, and, in the example shown in the first embodiment, since there is the speed change of 2% due to the change in image print ratio, the change of 5% at the maximum (2%+3% of change in the conveying speed of the pressure roller 34 ) must be absorbed. Thus, so long as the change in speed of 4% generated when the recording material P is pulled by the pressure roller 34 cannot be absorbed, the practical problem cannot be solved. Therefore, the outer diameter of the pressure roller 34 must be controlled with high accuracy or the thickness of the rubber layer of the pressure roller 34 must be made thinner extremely (for example, 1.5 mm or less), which makes the image forming apparatus expensive and makes high speed operation difficult.

When the solid elastic layer **5*b* is used in the transfer roller 5, in the heating/fixing device 12** of film heating type and pressure roller driving type, the margin for the change in the recording material conveying speed becomes great.

Next, when the recording material conveying speed of the pressure roller 34 is greater than that of the transfer roller 5 by 3%, conditions that do not cause the problems regarding the image will be explained on the basis of test examples.

The pressure roller 34 used in the heating/fixing device 12 of film heating type and pressure roller driving type was constituted by an iron core cylinder **34*a* having a diameter of 10 mm, and a silicone rubber layer 34*b* having hardness of 25 degrees (test piece hardness JIS-A when a load of 1 Kg is applied) and a thickness of about 4 mm. The roller was polished to have an outer diameter of 16.5 mm. In this case, the roller hardness of the pressure roller was 51 degrees (Asker-C when a load of 1 Kg is applied) and the urging force against the fixing film 31 was 6 Kg On the other hand, various transfer rollers constituted by an iron core cylinder 5*a* and silicone rubber layers having a thickness of about 3.5 mm and various rubber hardness from 10 degrees to 50 degrees were prepared. In this case, in order to reduce the friction force, fluororesin or silicone resin was dispersed in each silicone rubber layer 5*b***.

Outer diameters of the transfer roller 5 and the pressure roller 34 were adjusted so that the recording material conveying speed of the pressure roller 5 becomes greater than that of the transfer roller by 3%.

Test results in the following examples are shown in Table 3.

TABLE 3

| Transfer roller 5 | Silicone rubber hardness | Transfer roller hardness | Friction force to photosensitive drum |
|---|---|---|---|
| A1 | 10 degrees | 32 degrees | 15.1 times |
| B1 | 15 degrees | 41 degrees | 18.8 times |
| C1 | 20 degrees | 51 degrees | 12.6 times |
| D1 | 30 degrees | 59 degrees | 12.2 times |
| E1 | 50 degrees | 68 degrees | 11.6 times |
| F1 | 15 degrees | 41 degrees | 8.6 times |
| G1 | 25 degrees | 56 degrees | 7.6 times |
| H1 | 35 degrees | 63 degrees | 6.9 times |

where, the rubber hardness is represented by JIS-A hardness when a load of 1 Kg is applied and the roller hardness is represented by Asker-C hardness when a load of 1 Kg is applied.

Samples F1, G1 and H1 were obtained by dispersing silicone resin of 20 parts in the silicone rubber were prepared. Such silicone rubber is referred to as "silicone rubber B".

TABLE 4

| Transfer roller | A1 | B1 | C1 | D1 | E1 | F1 | G1 | H1 |
|---|---|---|---|---|---|---|---|---|
| Image | x | x | x | Δ | ○ | x | x | ○ |

In the Table 4, the evaluation of the image was determined by judging whether there is the shearing of the image or the elongation of image at an area where the recording material P is conveyed by the heating/fixing device 12 upon output of the half tone image. From the test results, it was found that, when the friction forces to the photosensitive drum are in the range illustrated in the test examples, the degree of contribution of the rubber hardness of the transfer roller 5 is greater than the value of the friction force. More specifically, it was found that, when the rubber hardness of the elastic layer 5*b* of the transfer roller 5 is greater than the rubber hardness of the elastic layer 34*b* of the pressure roller 39, a good image can be obtained. The reason is that, as described in connection with the first embodiment, since the recording material holding force of the transfer nip T depends upon the restoring force of the elastic layer 5*b* of the transfer roller 5, the harder the hardness of the elastic layer 5*b* the stronger the restoring force (i.e., the stronger the recording material holding force).

In this way, by using the transfer roller 5 having the solid elastic layer 5*b* described in connection with the first embodiment and by selecting the hardness of the elastic layer 5*b* to be greater than the hardness of the elastic layer 34*b* of the pressure roller 34 of the heating/fixing device 12, in the heating/fixing device 12 of pressure roller driving type and film heating type, even when the distance between the transfer nip T and the fixing nip N is smaller than the maximum length of the recording material P, an image forming apparatus having sufficient margin regarding the change in the recording material conveying speed of the pressure roller 34 can be obtained.

Fifth Embodiment

A fifth embodiment of the present invention is characterized in that a mold releasing layer 34*c* made of fluororesin (PFA tube, FEP tube or coating layer made of PFA or FEP) is included (as a surface layer) in the elastic layer 34*b* (made of silicone rubber) of the pressure roller 34 of the heating/fixing device 12.

By providing such a mold releasing layer 34*c*, not only the toner contamination of the pressure roller 34 can be prevented, but also the recording material holding force of the fixing nip becomes smaller than that of the transfer nip because of the presence of the resin layer 34*c*, with the result that the margin regarding the phenomenon that the image is elongated or sheared by pulling the recording material P by the pressure roller 34 (as described in connection with the fourth embodiment) can be increased.

This is obtained by reducing the restoring force in the nip N of the elastic layer 34*b* due to the presence of the resin layer 34*c*.

In the case where the recording material P is conveyed by the pressure roller 34, if the conveying speed of the pressure roller becomes greater than the conveying speed of the transfer roller 5, when abnormality does not appear on the image, the recording material P is always slipped on the surface layer of the pressure roller in the fixing nip N, with the result that the surface layer of the pressure roller (when constituted by only the rubber layer) will be easily worn. However, by providing the fluororesin layer 34*c* as the surface layer, the durability can be improved.

Accordingly, in the case where the resin layer 34*c* is provided as the surface layer of the pressure roller, even when the transfer roller has the surface layer constituted by only the elastic layer 5*b*, by maintaining the relation described in connection with the fourth embodiment, the sufficient margin for change of recording material conveying speed can be obtained, and, even when the resin layer 5*c* is provided on the transfer roller 5, by selecting the thickness of the resin layer 5*c* to be equal to or smaller than the thickness of the resin layer 34*c* of the pressure roller 34 and by maintaining the relation described in connection with the fourth embodiment, the same advantage as the fourth embodiment can be obtained.

As a result, the toner does not adhere well to both the transfer roller 5 and the pressure roller 34, and both the transfer roller 5 and the pressure roller 34 are hard to be worn, thereby improving the durability to permit application to a high speed image forming apparatus.

Now a concrete example will be described.

The transfer roller 5 is constituted by an iron core cylinder 5*a* having a diameter of 6 mm, an elastic layer 5*b* made of NBR and having a thickness of 5 mm, and an urethane resin layer (surface layer) 5*c* having a thickness of 30 $\mu$m and obtained by dispersing fluroresin in the urethane resin. In this case, roller hardness of the transfer roller 5 is selected to 50 degrees (Asker-C hardness when a load of 1 Kg is applied) and the resistance value is selected to $2\times10^8$ Ω.

On the other hand, the pressure roller 34 is constituted by an iron core cylinder 34*a* having a diameter of 10 mm, an elastic layer 34*b* made of silicone rubber and having a thickness of 3 mm, and a PFA tube layer (surface layer) 34*c* having a thickness of 50 $\mu$m.

A relation between the recording material conveying speed of the transfer roller 5 and the recording material conveying speed of the pressure roller 34 is selected so that, when the recording material conveying speed of the pressure roller 34 is increased due to thermal expansion of the pressure roller during continuous conveyance of the recording materials, the recording material conveying speed of the pressure roller becomes greater than the recording material conveying speed of the transfer roller by 3%.

As a result, any abnormality does not appear on the image in use, the durability is excellent so that, even after 300,000 normal sheets having A4 size were printed, abnormality does not appear on the surface layer of the transfer roller, noticeable wear of the pressure roller and the transfer roller cannot be found in spite of the fact that the recording material is subjected to tension between the pressure roller and the transfer roller, the surfaces of the transfer roller 5 and the pressure roller 34 are not smudged, and the same ability as the initial ability can be maintained.

Incidentally, in the fourth and fifth embodiments, while the function and effect of the heating/fixing device 12 of pressure roller driving type and film heating type were explained, the present invention can be applied to heating/fixing devices (other than film heating type) in which a recording material is dominantly conveyed by a pressure roller.

A heating/fixing device of heat roller fixing type is mainly constituted by a heat roller (fixing roller) as a heating rotary member, and an elastic pressure roller (pressurizing rotary member) urged against the heat roller. While the pair of rollers are being rotated, when the recording material on which the non-fixed toner image was formed is passed through a fixing nip between these rollers, the non-fixed toner image is fixed to the recording material as a permanent image by heat from the heat roller and pressure at the fixing nip.

What is claimed is:

1. An image forming apparatus comprising:

an image bearing member for bearing a toner image;

a transfer rotary member for forming a nip with said image bearing member and for transferring the toner image from said image bearing member onto a transfer material, said transfer rotary member including a solid surface layer having a surface friction force greater than that of said image bearing member by 3 to 20 times; and fixing means for pinching and conveying the transfer material and for fixing the toner image said fixing means including a driving rotary member having a rubber layer;

wherein a surface moving speed of said transfer rotary member is greater than a surface moving speed of said image bearing member, and a surface moving speed of said driving rotary member is greater than the surface moving speed of said transfer rotary member.

2. An image forming apparatus according to claim 1, wherein the surface moving speed of said transfer rotary member at said nip is greater thin the surface moving speed of said image bearing member at said nip by 1 to 5%.

3. An image forming apparatus according to clam 1, wherein said transfer rotary member is urged against said image bearing member with pressure of 200 to 800 g/cm$^2$.

4. An image forming apparatus according to claim 1, wherein, when the transfer material does not exist in said nip, an electrical field through which toner is transferred from said transfer rotary member to said image bearing member is formed.

5. An image forming apparatus according to claim 1, wherein said transfer rotary member has a resistance value of $10^6$ to $10^{10}$ Ω.

6. An image forming apparatus according to claim 1, further comprising a heating rotary member pressurizing said driving rotary member.

7. An image forming apparatus according to claim 6, wherein said driving rotary member has a fluororesin layer provided on an outer surface of said driving rotary member and a rubber layer provided inside of said fluororesin layer, and said transfer rotary member is provided at its surface with a rubber layer made of material other than resin.

8. An image forming apparatus according to claim 6, wherein said driving rotary member has a fluororesin layer provided on an outer surface of said driving rotary member and a rubber layer provided in side of said fluororesin layer, and said transfer rotary member is provided at its surface with a resin layer having thickness smaller than a thickness of said fluororesin layer.

9. An image forming apparatus according to claim 1, wherein said transfer rotary member consists of a core member and a solid rubber layer provided around said core member, and a hardness of said rubber layer of said transfer rotary member is greater than a hardness of said rubber layer of said driving rotary member.

10. An image forming apparatus according to claim 1, wherein said transfer rotary member has a roller shape.

* * * * *

UNITED STATES PATENT AND TRADEMARK OFFICE

CERTIFICATE OF CORRECTION

PATENT NO. : 6,085,058

DATED : July 4, 2000

INVENTOR(S): MASAHIRO GOTO, ET AL.

It is certified that error appears in the above-identified patent and that said Letters Patent is hereby corrected as shown below:

COLUMN 1:
Line 23, "(transfer material,)" should read --(transfer material)--.

COLUMN 2:
Line 50, "a" should be deleted.

COLUMN 4:
Line 20, "roller" should read --roller 5,--.

COLUMN 6:
Line 39, "EFDM" should read --EPDM--;
Line 42, "50 be" should read --be 50--; and
Line 49, "75 g/M$^2$" should read --75 g/m$^2$--.

COLUMN 7:
Line 62, "((=) corresponding" should read --((=) corresponds to--.

COLUMN 8:
Line 34, "for a the" should read --for the--.

UNITED STATES PATENT AND TRADEMARK OFFICE

CERTIFICATE OF CORRECTION

PATENT NO. : 6,085,058

DATED : July 4, 2000

INVENTOR(S): MASAHIRO GOTO, ET AL.

It is certified that error appears in the above-identified patent and that said Letters Patent is hereby corrected as shown below:

COLUMN 10:
Line 36, "that" should read --of--.

COLUMN 11:
Line 47, "(polytetrafluorethlene)" should read --(polytetrafluorocthylene)--; and
Line 48, "(perfluoralkocy)" should read --(perfluoroalkoxy)--.

COLUMN 14:
Line 49, "obtained" should read --prepared--;
Line 50, "rubber were pre-" should read --rubber.--; and
Line 51, "pared." should be deleted.

COLUMN 15:
Line 5, "roller 39" should read --roller 34--.

UNITED STATES PATENT AND TRADEMARK OFFICE

CERTIFICATE OF CORRECTION

PATENT NO. : 6,085,058

DATED : July 4, 2000

INVENTOR(S): MASAHIRO GOTO, ET AL.

It is certified that error appears in the above-identified patent and that said Letters Patent is hereby corrected as shown below:

COLUMN 17:

Line 8, "thin" should read --than--.

Signed and Sealed this

Tenth Day of April, 2001

Nicholas P. Godici

*Attest:*

NICHOLAS P. GODICI

*Attesting Officer*

*Acting Director of the United States Patent and Trademark Office*